US012504018B2

(12) United States Patent
Lee et al.

(10) Patent No.: US 12,504,018 B2
(45) Date of Patent: Dec. 23, 2025

(54) ELECTRICAL SUBMERSIBLE MOTOR PROTECTING SYSTEM AND METHOD WITH CHEMICAL CHAMBER

(71) Applicant: Alkhorayef Petroleum Company, Dammam (SA)

(72) Inventors: Woon Yung Lee, Sugar Land, TX (US); Ying Xue, Shanghai (CN); Junsik Kim, Pohang (KR); Carlos Leon, Bogota, CO (US); Carlos Escobar, Bogota, CO (US)

(73) Assignee: Alkhorayef Petroleum Company, Dammam (SA)

( * ) Notice: Subject to any disclaimer, the term of this patent is extended or adjusted under 35 U.S.C. 154(b) by 69 days.

(21) Appl. No.: 18/354,685

(22) Filed: Jul. 19, 2023

(65) Prior Publication Data

US 2025/0027504 A1 Jan. 23, 2025

(51) Int. Cl.
*F04D 25/06* (2006.01)
*E21B 37/06* (2006.01)
*E21B 43/12* (2006.01)

(52) U.S. Cl.
CPC ..... *F04D 25/0686* (2013.01); *E21B 37/06* (2013.01); *E21B 43/128* (2013.01)

(58) Field of Classification Search
CPC .... F04D 13/062; F04D 13/10; F04D 25/0686; E21B 37/06; E21B 43/128
USPC ..... 417/414
See application file for complete search history.

(56) References Cited

U.S. PATENT DOCUMENTS

RE32,866 E * 2/1989 Cruise ..... E21B 43/128 166/371
7,367,400 B1 * 5/2008 Howell ..... H02K 5/132 166/66.4

OTHER PUBLICATIONS

SONOMA Technologies & Services; Safety Data Sheet (SDS)—Scale Inhibitor.
SONOMA Technologies & Services; Odessa Separator, Inc. (OSI); Fluid Conditioning Systems; William Andres Aya Arias; www.odessaseparator.com; 2022.

* cited by examiner

*Primary Examiner* — Bryan M Lettman
(74) *Attorney, Agent, or Firm* — Eschweiler & Potashnik, LLC

(57) ABSTRACT

An electric submersible pump system for use in a wellbore includes a pump; a motor protection component having an oil chamber and an wellbore fluid chamber; a motor component, the motor component including oil and being fluidly coupled to the oil chamber of the motor protection component; and a chemical chamber that includes a neutralization chemical. The neutralization chemical includes a scale inhibitor. The chemical chamber is configured to contact fluid from the wellbore with the neutralization chemical and is fluidly coupled to the wellbore fluid chamber of the motor protection component. The pump is configured to be driven by the motor component. A chemical chamber and a method for operating an electric submersible pump are also disclosed.

20 Claims, 6 Drawing Sheets

ELECTRICAL SUBMERSIBLE MOTOR PROTECTING SYSTEM AND METHOD WITH CHEMICAL CHAMBER

FIELD

The technology disclosed herein relates to an electrical pump, in particular for a submersible pump for use in a wellbore.

BACKGROUND

Electrical submersible pump (ESP) systems are a type of artificial lift system used in oil and gas wells to increase the flow of fluids (such as water and/or oil) to the surface. An ESP generally includes a pump that is submerged in the wellbore and is powered by a downhole electric motor. The ESP system is designed to operate under high temperatures, pressures, and corrosive conditions, making it suitable for use in harsh downhole environments.

The main purpose of an ESP system is to increase production of oil and gas. This can be done by either increasing the speed or volume of fluid flow, but most wells have a fixed production rate. Production could also be improved by reducing downtime by making the ESP more reliable, less prone to breaking down, and/or easier and quicker to repair. Replacing or repairing an ESP requires significant time and cost in preparing the wellbore to perform the change out operation. Often the preparation for servicing the ESP involves even more time than the time to replace or repair the ESP. Costs are very significant to pull up piping from a deep well, especially an off-shore well, where a barge and crane must be used for removing the pipeline and replacing it.

Overall, the development of ESP technology has been driven by the need to increase oil and gas production in challenging downhole environments. As such, ongoing research and development in this field are expected to continue to drive innovation and improvements in ESP technology. There is a need for increased reliability for the ESP motor and its related components.

SUMMARY

The following is a brief summary of subject matter that is described in greater detail herein. This summary is not intended to be limiting as to the scope of the claims.

In some aspects, the techniques described herein relate to an electric submersible pump system for use in a wellbore, which includes a pump; a motor protection component having an oil chamber and an wellbore fluid chamber; a motor component, the motor component including oil and being fluidly coupled to the oil chamber of the motor protection component; and a chemical chamber that includes a neutralization chemical. The neutralization chemical includes a scale inhibitor. The chemical chamber is configured to contact fluid from the wellbore with the neutralization chemical and is fluidly coupled to the wellbore fluid chamber of the motor protection component. The pump is configured to be driven by the motor component.

In some aspects, the techniques described herein relate to a method of operating an electric submersible pump system in a wellbore, including: starting a motor component for driving a pump; flowing wellbore fluid into a chemical chamber; neutralizing the wellbore fluid with a neutralizing chemical; heating oil in a motor component, causing it to expand into an oil chamber of a motor protection component; flowing neutralized wellbore fluid into a wellbore fluid chamber of a motor protection component.

In some aspects, the techniques described herein relate to a chemical chamber device for an electric submersible pump system, including: a chemical chamber cavity bounded by an outer housing, a filter, a chemical chamber inner tube, a head, and a floor portion. Chemical chamber tubing extends from the head of the chemical chamber into the chemical chamber cavity. The head is configured for attaching to a pump, and the chemical chamber inner tube is configured to surround a shaft. A passage is formed between the filter and the chemical chamber inner tube, and the passage terminates at a bottom of the chemical chamber. A neutralization chemical resides in the chemical chamber cavity.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
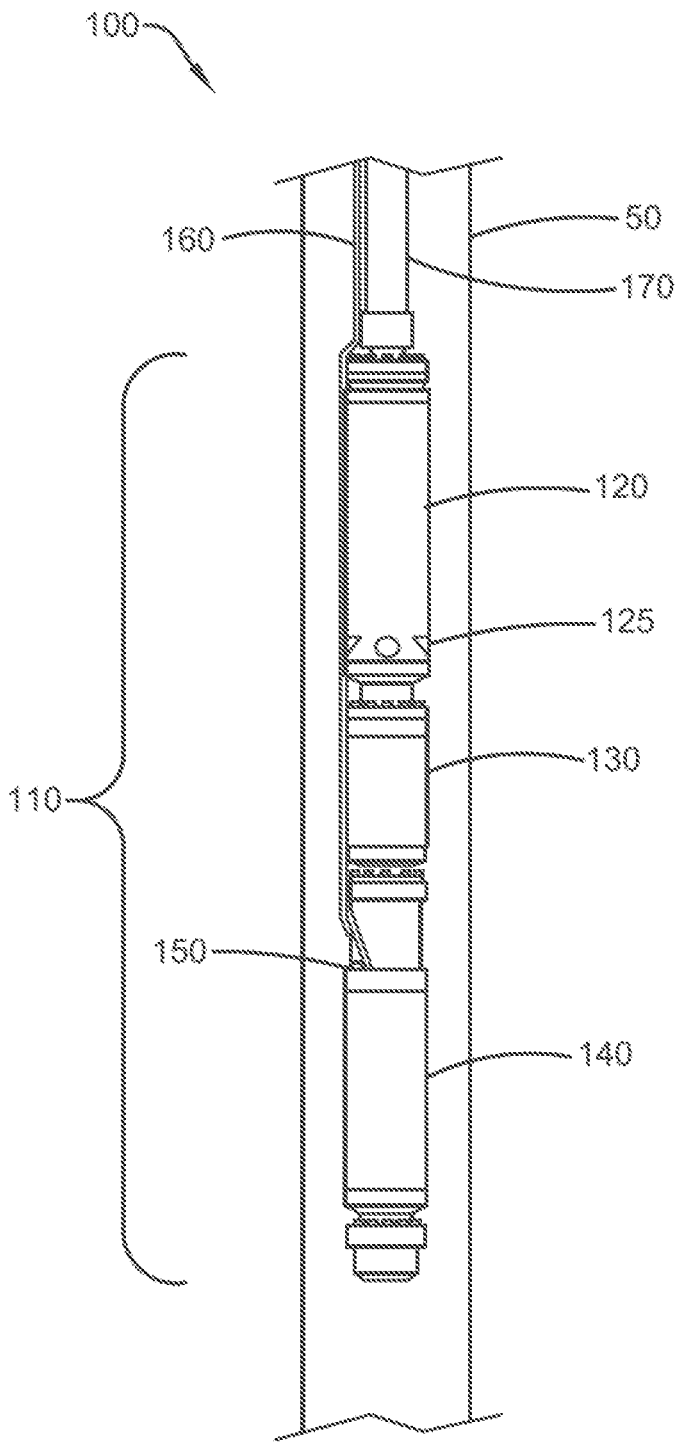
FIG. 1 is a vertical plan view of an exemplary ESP system in a wellbore.

Various technologies pertaining to electrical submersible pumps (ESPs) are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference. In addition, the terms "inner" and "outer" are in reference to the longest axis of the devices and systems disclosed herein. The term "fluidly coupled" means a fluid, such as oil, can flow through from one end of the area it relates to, to another. For example, X is fluidly coupled to Y, means fluid can flow through tubing or some channel or chamber from X to Y or vice versa.

Disclosed herein is a motor protecting system for an ESP, particularly for an ESP in a wellbore environment. The protection component is intended to extend the life of the ESP, thereby decreasing downtime of the well for maintenance of the ESP, and consequently improving production from the well.

For lubrication and other purposes, the electrical motor component of the ESP is filled with a dielectric motor oil. Due to the temperature of the motor changing during operation, the volume of motor oil changes accordingly. This change in volume may be described by equation (1)

$$\Delta V = V_o \beta \Delta T \tag{1}$$

$\Delta V$ is the change in volume, $V_o$ is the original volume. $\beta$ is the coefficient of volume expansion, and $\Delta T$ is the change in temperature. As the volume of the oil expands, it must have a reservoir to be pushed into. In an embodiment of an ESP this reservoir is a motor protector component that is an expandable bladder between the motor component and the rotating impellers of the pump. An expandable/contractable motor protector component acts to prevent the motor from well fluid contamination and also maintains a pressure balance between the wellbore and the internal chamber of the motor. This pressure equilibrium allows the expanding oil to freely move from the motor component to the motor protector component as the motor protector component is enabled to expand and contract. Without the ability of the motor protector component to expand and contract, the internal oil pressure in the motor would build up to undesired levels.

In operation, well fluid is allowed to enter and exit the motor protector component constantly as the motor temperature changes to equilibrate the pressure. While well fluid enters and stays in the motor protector component, harsh chemicals in the well fluid react with internal parts of the motor protector and with the motor oil. Eventually, the chemically damaged parts of the motor protector component cause leakage into the internal part of the protector and mix with the motor oil.

Addressing this problem, a system and method is provided herein to reduce the damage to the motor protector component by neutralizing the harsh well fluid that enters the protector component by filtering it through a pre-imbedded chemical material that is in chemical chamber. Accordingly, this system and method is expected to extend the runlife of the ESP in a wellbore and improve the overall production of the well.

With reference to FIG. 1, an exemplary system 100 for oil and gas production is illustrated as an overview exterior view of an ESP 110 disposed within the walls of a wellbore 50. The system 100 includes an ESP 110, which comprises a pump 120, a motor protection component 130, and a motor component 140. A power connector 150 is also shown at the top of the motor component 140. The power connector 150 is attached to a power conduit 160, which runs up the side of the ESP 110 and continues up to the top of the wellbore 50 where it is coupled to a power source.

In this embodiment, the motor component 140 is at a bottom end of the ESP and a top end of the motor component 140 is coupled to a bottom end of the motor protection component 130. A top end of the motor protection component 130 is coupled to the pump 120.

An intake opening 125 is on the side of the pump 120 near the bottom end of the pump 120. Fluid from the wellbore 50 comes into the ESP from this intake opening 125 and is pumped through the pump 120 up and out of the wellbore 50 via the production tubing 170.

Figure 2:
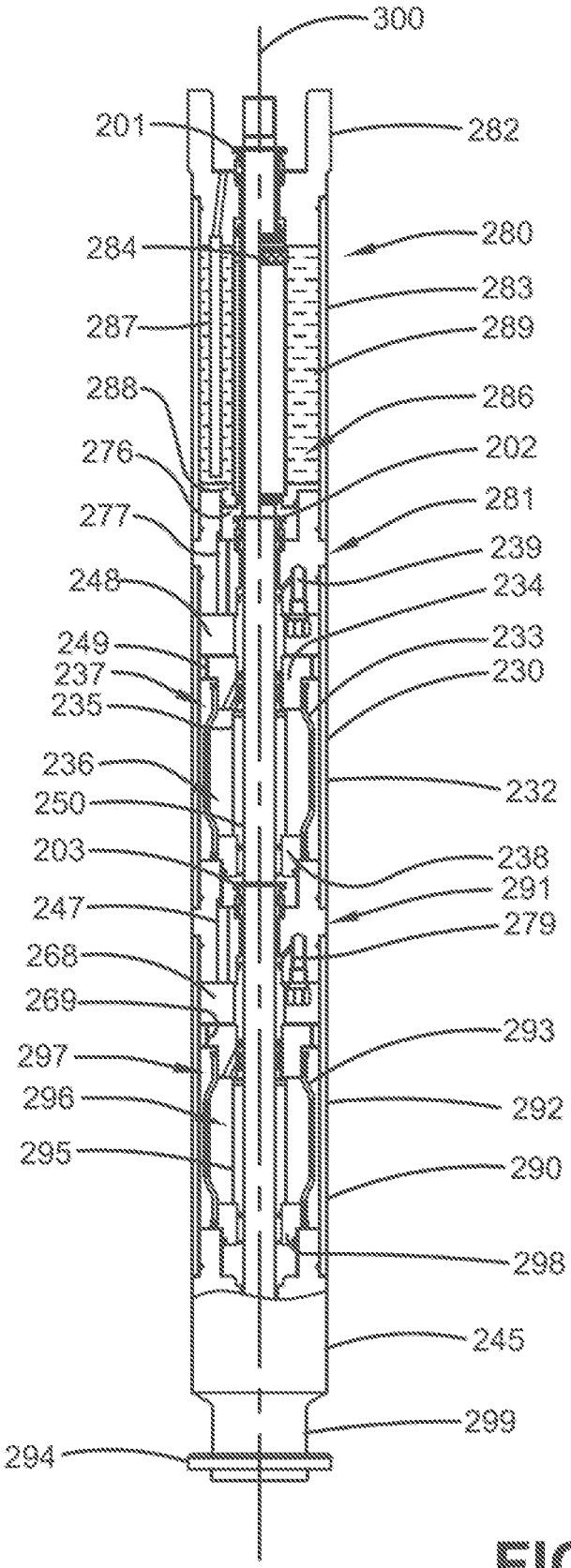
FIG. 2 is a partial cross-sectional view of an exemplary ESP system with a chemical chamber and a first and second motor protector component.

FIG. 2 is a cross-sectional view of an exemplary first motor protection component 230, a second motor protection component 290, and a chemical chamber 280. A top end of the chemical chamber 280 is coupled to a pump (see FIG. 1 pump 120). The bottom of the second motor protection component 290 is coupled a motor component (See FIG. 1, motor component 140) via a base 299 circumscribed by a base flange 294.

The first motor protection component 230, second motor protection component 290, and chemical chamber 280 are coupled through a first coupling body 281 and a second coupling body 291. The first and second coupling bodies 281, 291 are connectors that in an embodiment, function to efficiently attach the different fittings of the first and second motor protection components 230, 290 and the chemical chamber 280 together. The first and second coupling bodies 281, 291 also include a first tubing 277 and a second tubing 247, which are configured to allow fluid from one component to flow into the other component joined by the first and second coupling bodies 281, 291.

In the embodiment of FIG. 2, a second motor protection component 290 is utilized to further protect the motor component. This helps to prolong the life of unit and/or the intervals between servicing the ESP. However, the second motor protection component 290 is optional.

A shaft 250 runs through an axial center of the first motor protection component 230, second motor protection component 290, and chemical chamber 280. A bottom end of the shaft 250 runs from the motor component 140 to the pump 120 where it is attached to impellers in the pump 120. In an embodiment, the shaft 250 runs through a bearing chamber 245 at the bottom of the motor protection component 130.

The first motor protection component 230 includes an outer housing 232 and a flexible bag 233. The flexible bag may be made of an elastomeric material, such as butyl rubber, halobutyl rubber, nitrile rubber, natural rubber, styrene-butadiene rubber, or polybutadiene rubber, or mixtures thereof. Inside the flexible bag 233 is a first inner tube 235 within which the shaft 250 rotates upon impetus from the motor component 140. The first inner tube 235 prevents oil from the inside of the flexible bag 233 from contacting the shaft 250. An inner chamber 236 is formed inside the flexible bag 233 bounded on the inner circumference by the first inner tube 235 and on the outer circumference by the flexible bag 233. An outer chamber 237 is formed between the outside the flexible bag 233 (i.e., its outer circumferential surface) and the inside surface of the outer housing 232. The inner chamber 236 is also referred to herein as an oil chamber, and the outer chamber 237 is also referred to herein as a wellbore fluid chamber. It is contemplated that in another embodiment, with modifications, the oil chamber could be the outer chamber and wellbore fluid chamber could be inner chamber.

The flexible bag 233 is attached at the top to a top body 234 and at the bottom to a bottom body 238. These top and bottom bodies 234, 238 and their intersection with the flexible bag 233 also provide a boundary to the top and bottom of the inner chamber 236.

The second motor protection component 290 in an embodiment is the same as the first motor protection component 230, and it includes a second outer housing 292 and a second flexible bag 293. Inside the second flexible bag 293 is a second inner tube 295 within which the shaft 250 rotates upon impetus from the motor component 140. The second inner tube 295 prevents oil from the inside of the second flexible bag 293 from contacting the shaft 250. A second inner chamber 296 is formed inside the second flexible bag 293 bounded on the inner circumferential surface by the second inner tube 295 and on the outer circumferential surface by the second flexible bag 293. A second outer chamber 297 is formed between the outside of the second flexible bag 293 (i.e., its outer circumferential surface) and the inside surface of the second outer housing 292. The second inner chamber 296 is also referred to herein as a second oil chamber, and the second outer chamber 297 is also referred to herein as a second wellbore fluid chamber. It is contemplated that in another embodiment, with modifications, the oil chamber could be the second outer chamber 297 and the wellbore fluid chamber could be the second inner chamber 296.

The second flexible bag 293 is attached at the top to a second top body 264 and at the bottom to a second bottom body 298. These second top and bottom bodies 264, 298 and their intersection with the second flexible bag 293 also provide a boundary for the top and bottom of the second inner chamber 296.

In operation, the expanding oil flows from the motor component 140 to the second inner chamber 296 of the second motor protection component 290 through a passage between the second inner tube 295 and the bottom body 298. If the second motor protection component 290 is not present, the oil expands directly into the first motor protection component 230. Contracting oil can flow in reverse back down to the motor component 140. Excess expanding oil either flows into the first motor protection component 130 or into the first or second check valve 279, 239 to exit to the wellbore.

Clean oil passes to and from the motor component 140, first motor protection component 130, and second motor protection component 290 and flows through internal passages around the shaft or other passages near the shaft that are no further from the axis 300 than the flexible bag 233. The neutralized wellbore fluid passes from the intake opening 125 through various passages always separated from the clean oil pathways into the first and second outer chambers 237, 297.

The chemical chamber 280 incorporates the neutralization chemical 289 in a chemical chamber cavity 286 bounded by an outer housing 283 and a filter 284. The filter 284 is situated around a chemical chamber inner tube 285 which surrounds the shaft 250, for the same reasons as explained above. This filter 284 can be a cylindrical mesh, or in another embodiment, can be a tube with one or more openings near the top with a metallic mesh covering the openings. In either case, the filter 284 prevents large solid particles from entering the outer chamber 237 of the first motor protection component 230. In an embodiment, the filter 284 can be placed at other locations between the intake opening 125 and the outer chamber 237.

At the top of the chemical chamber 280 is a head 282, which is configured to couple (either directly or indirectly via one or more other coupling bodies) to the pump 120. A floor portion 288 bounds the bottom of the chemical chamber cavity 286.

Chemical chamber tubing 287 runs through the head 282 of the chemical chamber 280 and at its upper end is in fluidly coupled to an intake opening 125 for the wellbore fluid. The lower end of the chemical chamber tubing 287 extends down to near the bottom of the chemical chamber cavity 286, for example, the chemical chamber tubing 287 may extend down to within 25%, within 20%, or within 10% of the bottom length of the chemical chamber cavity 286.

The filter 284 has one or more small openings allowing neutralized wellbore fluid to enter a passage between the inside of the filter 284 and the outside of the chemical chamber inner tube 285. This passage terminates at the bottom of the chemical chamber 280 where it is coupled to a chamber 276 that is coupled to first tubing 277 that runs through the first coupling body 281 into the first motor protection component 230 via first and second passages 248, 249 into, specifically, the outer chamber 237 of the first motor protection component 230. The chemical chamber 280 is thus fluidly coupled to the outer chamber 237 of the first motor protection component 230. Similarly, the second tubing 247 that runs through the second coupling body 291 into the second motor protection component 290 via first and second passages 268, 269 into, specifically, the second outer chamber 297 of the second motor protection component 290. The chemical chamber 280 is thus fluidly coupled to the second outer chamber 297 of the second motor protection component 290 via the first motor protection component 230.

The shaft 250 runs along an axis 300, from the motor component 140 to the pump 120. The shaft 250 runs through the first and second motor protection components 230, 290, and through the chemical chamber 280. As discussed above, the shaft 250 is isolated in the interior of the ESP 110 by the first inner tube 235, second inner tube 295, and chemical chamber inner tube 285. Shaft seals 201, 202, 203 are located at the top of each component around the shaft 250. The shaft seals 201, 202, 203 are configured to prevent arbitrary leakages between chambers through the interface between the first inner tube 235, the second inner tube 295, and chemical chamber inner tube 285 that surrounds the shaft 250.

In an embodiment, an upper head portion of the motor protection component 130 is coupled to a base 369 of the modular chemical chamber 380. The modular chemical chamber 380 can be configured to fit on existing motor protection components 130.

Figure 3:
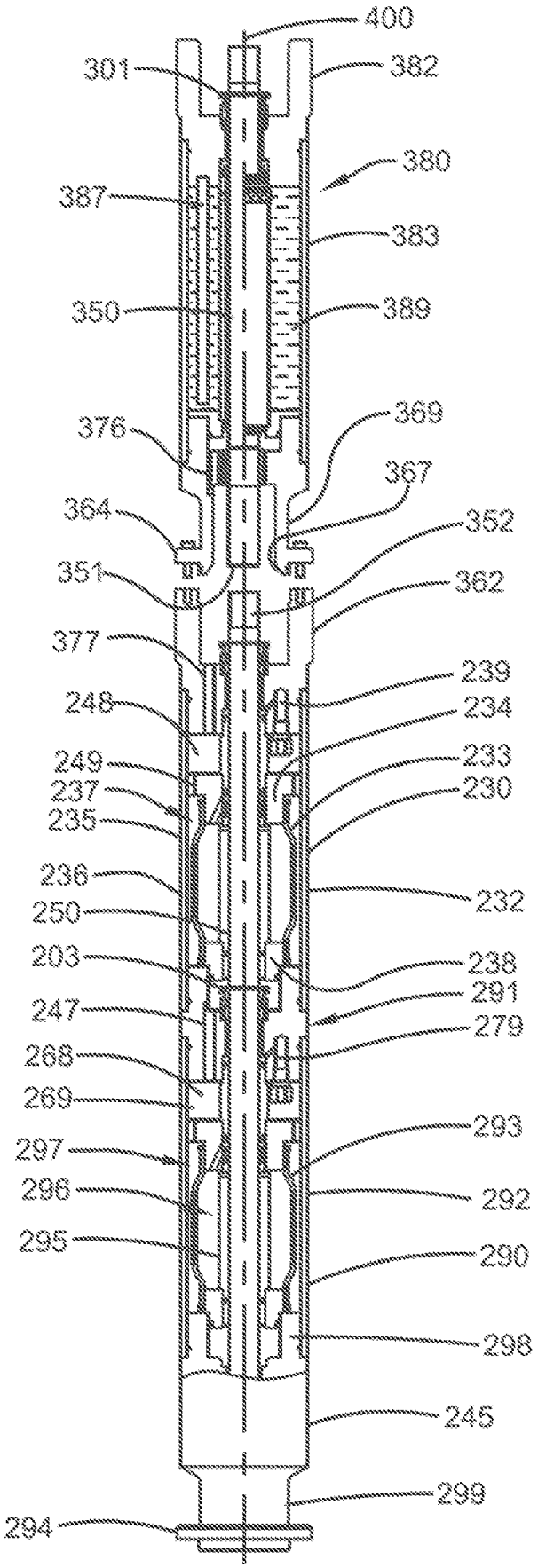
FIG. 3 is a partial cross-sectional view of another exemplary ESP system with a chemical chamber and a first and second motor protector component in a disassembled state.

In another embodiment disclosed in FIG. 3, a modular chemical chamber 380 is configured for quickly attaching or detaching to a first motor protection component 230. The modular chemical chamber 380 is configured with a base 369, and includes a shaft portion 350 that runs along a central axis 400. The first motor protection component 230 is includes a head 362, that is configured to quickly couple to a base 369 of the modular chemical chamber 380. In an embodiment, the head 362 may be identical to head 282 (of the device of FIG. 2) and head 382 on the modular chemical chamber 380 of FIG. 3.

In an embodiment, each head 362/282/382) is configured to quickly connect to the base 369. The upper surface of the head 362 is configured to abut the bottom surface of the head flange 364. The base 369 includes a lip portion 367 that fits concentrically within the inner surface of the head 362. The head 362 and base 369 can be attached, for example, by nut-and-bolt type threads on the inner surface of the head 362 and outer surface of the lip portion 367. Other forms of mechanical engagement could be used in addition or instead, such as, multiple nuts and bolts, clamps, or screws into preformed threaded holes.

The shaft portion 350 of the modular chemical chamber 380 is configured to engage with and attach at its bottom end 351 to a top end 352 of the shaft 250 residing in the first motor protection component 230. In an embodiment, a sleeve 459 is used to couple the bottom end 351 to the top end 352.

In an embodiment, the sleeve 459 can, for example, have screw-type threads that engage with matching threads on the bottom end 351 and the top end 352. Alternative connecting mechanisms can also be used, such as a detent pin system or a ball pin on one or more sides of the sleeve 459 matching with one or more detents on the bottom end 351 to the top end 352. The attachment can be threaded engagement that will be urged to tighten when the shaft 250 turns. Other mechanical configurations for attachment can be used in other embodiments.

Figure 6:
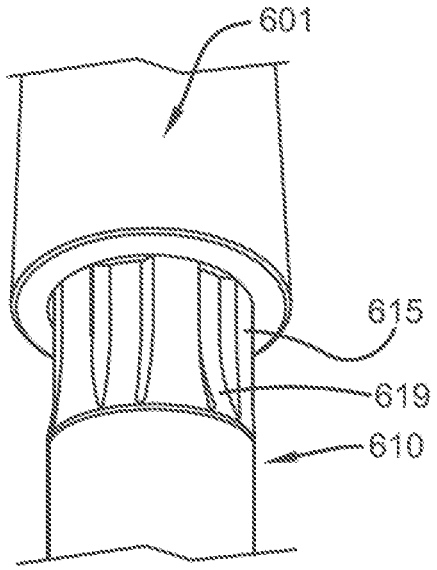
FIG. 6 is a perspective view of embodiments of an exemplary sleeve and shaft.
Figure 7:
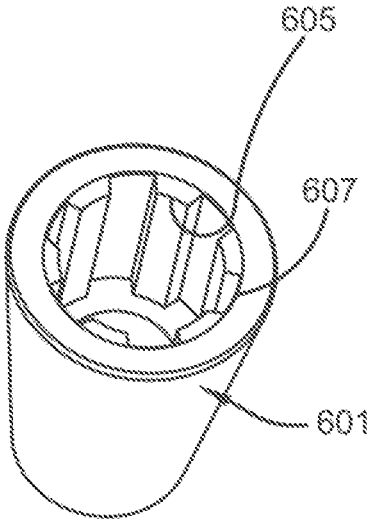
FIG. 7 is a perspective view of an embodiment of an exemplary sleeve.
Figure 8:
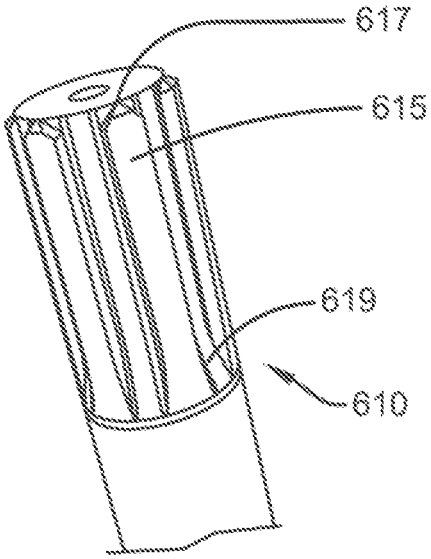
FIG. 8 is a perspective view of an embodiment of an exemplary shaft.

FIGS. 6, 7, and 8 are perspective views of an embodiment of the sleeve 601 and the shaft 610. The sleeve 601 has six raised ridges 605, with six depressed surfaces 607 therebetween each of which run vertically along the axis of the sleeve 601. The shaft 610 includes six matching raised ridges 615 that run vertically in line with the axis of the shaft and match the width of the depressed surfaces 607.

Each end of the sleeve 601 can be open to receive an end of the shaft 610. A shaft 610 can be inserted from both opens ends or in an embodiment, one shaft 610 is manufactured with the sleeve 601 on one end.

The open end of the sleeve 601 and shaft 610, when pressed together can have a tight friction fit, as the depressions 619 between the matched raised ridges 615 taper out axially to become less deep as the shaft extends. In an embodiment, the end 617 of the matched raised ridges 615 has a tapered width that becomes narrower as the end of the shaft 610 is approached. This allows for easier engagement with the sleeve 601.

Figure 4:
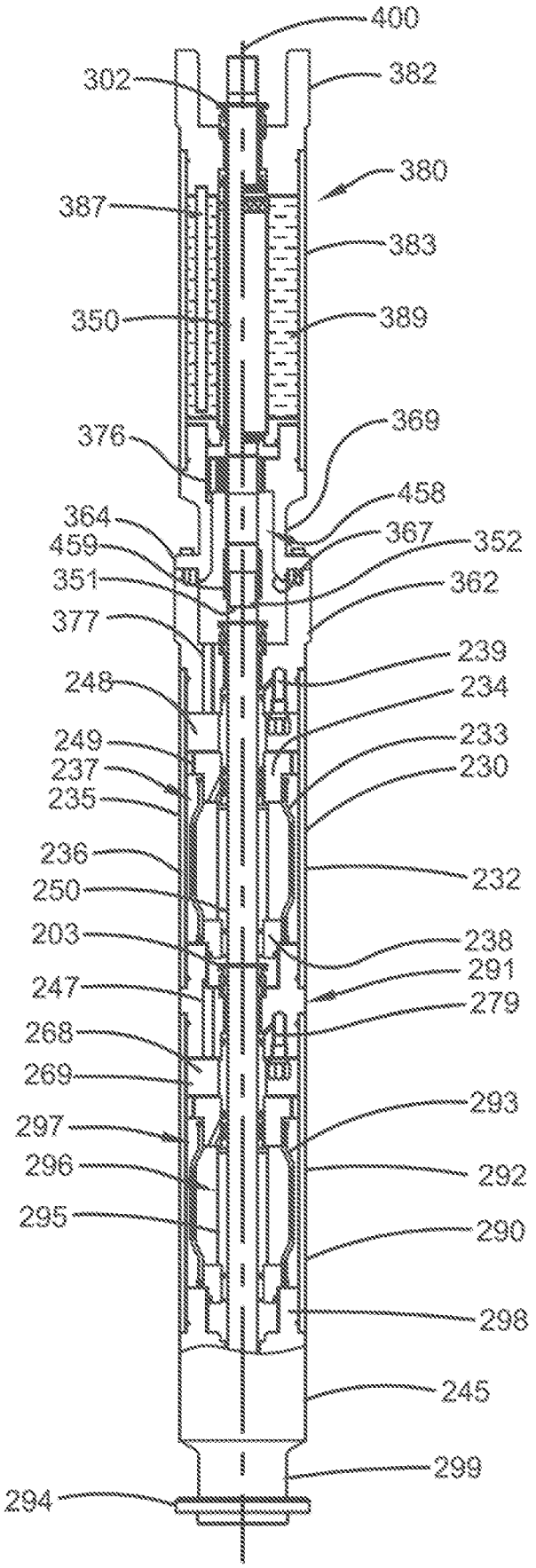
FIG. 4 is a partial cross-sectional view of the exemplary ESP system of FIG. 3 in an assembled state.

FIG. 4 shows the separate components of the embodiment of FIG. 3 assembled together. The modular chemical chamber 380 is configured for attaching or detaching to a first motor protection component 230. This embodiment, is configured to be readily attachable to a conventional motor protection component by a series of bolts.

Other than the head 382 and the base 369 components, the modular chemical chamber 380 is much the same as chemical chamber 280 of FIG. 2. Chemical chamber tubing 387, neutralization chemical 389, shaft seals 302, 304, first tubing 377, and outer housing 383, are substantially the same as in FIG. 2. An additional difference is that in an embodiment, the chamber 376 is configured differently from the chamber 276 of the device of FIG. 2, and a head-base chamber 458 is formed between the base 369 of the chemical chamber 280 and the head 362 of the first motor protection component 230. In an embodiment, the neutralized fluid may contact the shaft in the head-base chamber 458. Other components in FIGS. 3 and 4 are marked with the same numerals as in FIG. 2 to indicate their similarity.

In an embodiment, the neutralization chemical 289 is a scale inhibitor. A scale inhibitor delays or prevents scaling. Scaling is a buildup of minerals such as calcium carbonate ($CaCO_3$), calcium sulfate ($CaSO_4$), barium sulfate ($BaSO_4$), strontium sulfate ($SrSO_4$), and iron sulfide ($FeS_2$) on surfaces such as the flexible bag 233.

In an embodiment, the neutralization chemical 289 comprises one or more components selected from the group consisting of: phosphonates, phosphoric acid, ortho phosphates, and high molecular weight polymers (for example, 500,000 g/mol (weight average molecular weight), 750,000 g/mol, or 1 million g/mol or more) such as polyethylene oxide polymer. The neutralization chemical may also include one or more iron chelators, such as, for example, tetrakis hydroxymethyl phosphine chloride (THPC) and/or hydroxymethyl tetrakis phosphonium sulfate (THPS). In an embodiment, the neutralization chemical 289 is in the solid form at 25° C.

In addition, the neutralization chemical 289 can be selected to neutralize agents that cause corrosion, scale, or foaming, or to neutralize paraffins and asphaltenes. The neutralization material can include In an embodiment, the neutralization chemical 289 can be a modified form of the CHEM-STICK material from Odessa Separator, Inc.

In an embodiment, the material is a solid particulate or porous material. The material should have sufficient porosity or low enough density to flow water, oil, or wellbore fluid through the thickness of the neutralization chemical 289 between the outer housing 283 and the filter 284. This thickness of the chemical chamber cavity 286 may be, for example, 0.25 to 3 inches, such as, for example, 1 to 2.5 inches, or 1.25 to 2 inches. The height of the chemical chamber cavity 286 may be 2 inches to 3 feet, such as, for example, 4 inches to 2 feet, or 8 inches to 20 inches.

A volume of the neutralization chemical 289 is sufficient for neutralization treatment of the wellbore fluid for many hours of use, for example, its entire lifetime, such as up to 60,000 hours, for example, 168 hours to 3000 hours, or 672 hours to 4380 hours. A sufficient volume of the neutralization chemical 289 in the chemical chamber cavity 286 is, for example, 1.6 $in^3$ to 4070 $in^3$, such as, for example, 3 $in^3$ to 2,000 $in^3$, or 100 $in^3$ to 1000 $in^3$. The neutralization chemical 289 is present in the chemical chamber cavity 286 in a volume sufficient to treat, i.e., neutralize, a wellbore fluid volume of, for example, 0.1 to 5 gallons, such as, for example, 1 to 4 gallons, or 2 to 3 gallons.

In a method of assembling the ESP 110, part of the ESP 110 is assembled in a factory with the motor component 140 and motor protection component 130, these are then filled with clean motor oil. At the wellbore site, the ESP 110 is assembled by coupling the pump 120 to the bottom of the production tubing 170, coupling the pump 120 to the chemical chamber 280, coupling the chemical chamber 280 to the motor protection component 130 (which may optionally be first and second motor protection components 230, 290) which was preassembled with the motor component 140. This method is particularly applicable to the modular chemical chamber 380 embodiment of FIG. 3. In the embodiment of FIG. 2, chemical chamber 280 is an added part to motor protection component 230 and can be manufactured as a single unit, i.e., within the same housing.

The chemical chamber 280 is preloaded with the neutralizing chemical and the motor component 140 is preloaded with oil in an amount sufficient to lubricate the motor at a low temperature, e.g., down to 20° C. at standard atmospheric pressure. The ESP 110 is then dropped down into the wellbore 50. The ESP 110 with the chemical chamber 280 may be installed in a wellbore 50 at depths of, for example, 4 to 10,000 foot, such as, for example, 200 to 7,500 feet, or 1,000 to 7,500 feet.

In operation, the ESP 110 is lowered into the wellbore. The clean motor oil in the motor component 140 expands as the ambient temperature in the wellbore is elevated at significant depths compared to ambient temperature at the surface. If the expanding oil becomes too high in volume it may overflow via a check valve 239/279 to exit to the wellbore. Still the motor component 140 and motor protector component 130 are filled with clean oil.

When the motor component 140 is electrically started and begins running, the motor temperature will increase even higher and more expansion of the oil will take place. If there is excess oil over the capacity of the motor protection component 130, it can overflow into another motor protection component or through a valve to outside the ESP 110. When the motor is running, the wellbore fluid flows into the intake opening 125 as it is sucked in by impellers of the pump 120. Most of the wellbore fluid is sent out of the top of the pump 120 into the production tubing 170. A minor part of the wellbore fluid is sucked into the chemical chamber 280 due to contraction of the oil volume, specifically into the chemical chamber tubing 287 that extends to the bottom of the chemical chamber cavity 286. The wellbore fluid in the chemical chamber cavity 286 then contacts and reacts with the neutralization chemical 289, is filtered through the filter 284, and the neutralized wellbore fluid is flowed through the chemical chamber tubing 287 and into the outer chamber 237/297 of the motor protection component 130. As the oil in the motor component 140 begins to heat up from heat generated from the activated motor, the oil expands. The motor component 140 and the inner chamber 236 are fluidly coupled such that the expanding oil expands out of the motor component into the inner chamber 236 of the motor protection component 130. If the motor component 140 is stopped or shut down or the oil cools down due to external temperature changes, the oil in the inner chamber will contract and migrate back into the motor component 140, and this volume is replaced by neutralized wellbore fluid from the chemical chamber cavity 286.

Figure 5:
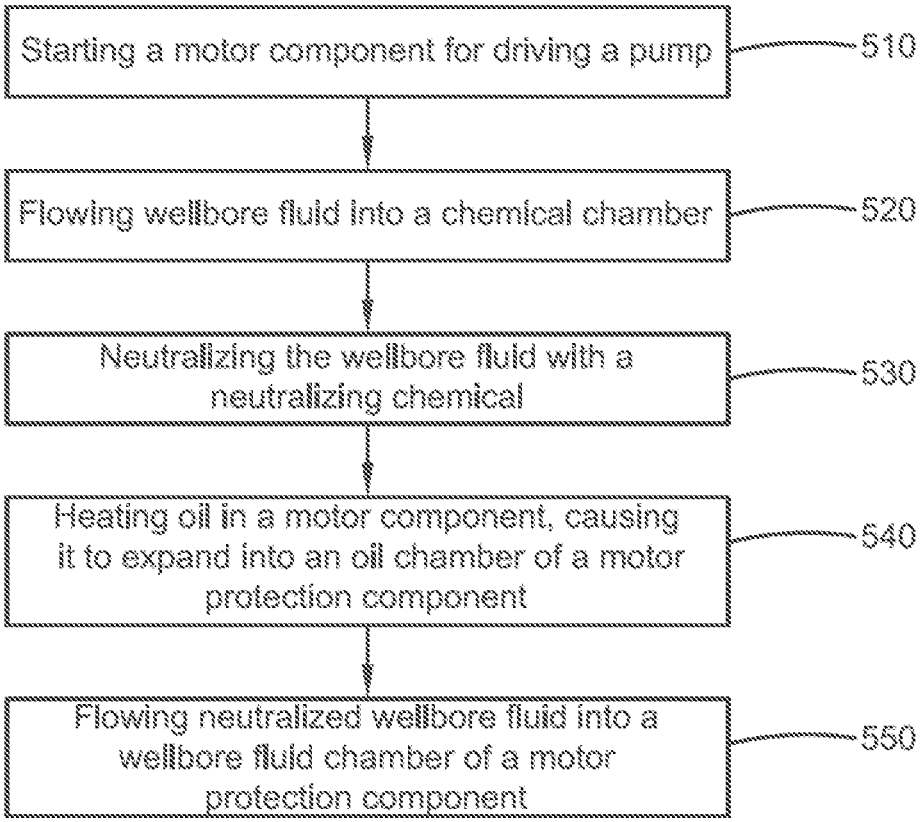
FIG. 5 is a flowchart of an example method for operating an electric submersible pump system in a wellbore.

The method of operation is also shown in FIG. 5. FIG. 5 is a flowchart of an example method for operating an electric submersible pump system in a wellbore. At step 510, a motor component for driving a pump is electrically signaled to start. Electric power is supplied and the motor turns, thereby turning shaft and the pump impellers. At step 520, wellbore fluid is flowed into a chemical chamber. In an embodiment, this wellbore fluid is, for example, 0.1 to 5 gallons, such as, for example, 1 to 4 gallons, or 2 to 3 gallons. At step 530, the wellbore fluid is neutralized with a neutralizing chemical. At step 540, oil in the motor component heats up due to friction and movement of parts in the motor. This causes the oil to expand into an oil chamber of a motor protection component. At step 550, due to the contraction of oil volume in the motor and the motor protection component, neutralized wellbore fluid will migrate into the motor protection component 130. The volume of the neutralized wellbore fluid will be, for example, 0.1 to 5 gallons, such as, for example, 1 to 4 gallons, or 2 to 3 gallons. In an embodiment, once the neutralized wellbore fluid enters into the motor protection component 130, the neutralized wellbore fluid will dwell in the motor protection component 130 for the lifetime of the ESP 110, or at least until it is removed from the well and serviced. There may be some fluctuation in the flow of the neutralized wellbore fluid if the motor component temperature or ambient temperature in the wellbore rises or falls during operation, but the majority of the initially neutralized wellbore fluid will remain in the motor protection component 130 (specifically the outer chamber).

In a method of servicing the ESP 110, the motor component 140 driving the pump 120 is shut down and pulled up from the wellbore 50. In the ESP 110 according to the embodiment of FIGS. 3 and 4 the modular chemical chamber 380 can be unscrewed or otherwise quickly detached from the pump 120 and the motor protection component 130. A new modular chemical chamber 380 can be attached to the pump 120 and the motor protection component 130. Alternatively the neutralization chemical 289 in the modular chemical chamber 380 could be removed and replaced with new (unreacted) neutralization chemical 289, and then replaced into the ESP 110. The motor protection component 130, motor component 140 and pump 120 could also be inspected and serviced if needed at this time. Oil quality and volume can be inspected and the oil can be changed as well. The assembled ESP 110 is then inserted back into the wellbore 50, and, once in place, the motor component 140 driving the pump 120 is restarted and production of hydrocarbons from the well resumes.

The servicing procedure with the ESP 110 according to the embodiment of FIG. 2 would be similar. However, the chemical chamber 280 of that embodiment is not so easily detachable and reconnectable, and may require detaching the pump 120, motor protection component 130 and motor component 140 to account for the one piece shaft 250. Another advantage of the modular chemical chamber 380 is that it is configured to be compatible to couple with existing motor protection units.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim. The term "consisting essentially" as used herein means the specified materials or steps and those that do not materially affect the basic and novel characteristics of the material or method. If not specified above, the properties mentioned herein may be determined by applicable ASTM standards, or if an ASTM standard does not exist for the property, the most commonly used standard known by those of skill in the art may be used. The articles "a," "an," and "the," should be interpreted to mean "one or more" unless the context indicates the contrary.

What is claimed is:

1. An electric submersible pump system for use in a wellbore comprising:

a pump;

a motor protection component having an oil chamber and a wellbore fluid chamber;

a motor component, the motor component comprising oil and being fluidly coupled to the oil chamber of the motor protection component; and a chemical chamber that includes a neutralization chemical, the neutralization chemical comprising a scale inhibitor;

the chemical chamber being configured to contact fluid from the wellbore with the neutralization chemical and being fluidly coupled to the wellbore fluid chamber of the motor protection component;

wherein the pump is configured to be driven by the motor component;

wherein the scale inhibitor is an iron chelator selected from the group consisting of: tetrakis hydroxymethyl phosphine chloride (THPC) and hydroxymethyl tetrakis phosphonium sulfate (THPS).

2. The electric submersible pump system of claim 1, wherein the scale inhibitor further comprises: one or more components selected from a group consisting of: phosphonates, phosphoric acid, ortho phosphates, a polymer having a weight average molecular weight of 500,000 g/mol to 1,000,000 g/mol, and a polyethylene oxide polymer.

3. The electric submersible pump system of claim 1, wherein the metal chelator is tetrakis hydroxymethyl phosphine chloride (THPC).

4. The electric submersible pump system of claim 1, wherein the oil chamber and the wellbore fluid chamber are separated by an elastomeric material.

5. The electric submersible pump system of claim 1, further comprising a shaft extending from the motor component to the pump, wherein the chemical chamber surrounds an inner tube that surrounds the shaft.

6. The electric submersible pump system of claim 1, wherein tubing is fluidly coupled to the chemical chamber at one end and at another end is fluidly coupled to the wellbore fluid chamber of the motor protection component.

7. The electric submersible pump system of claim 1, wherein chemical chamber tubing runs through a head of the chemical chamber and the chemical chamber tubing is fluidly coupled to an intake opening for wellbore fluid.

8. The electric submersible pump system of claim 7, further comprising a shaft extending from the motor component to the pump;

wherein a base of the chemical chamber and a head of the motor protection component form a chamber, wherein a first and second section of the shaft are coupled together.

9. The electric submersible pump system of claim 1, wherein the oil chamber is an inner chamber and the wellbore fluid chamber is an outer chamber of the motor protection component.

10. The electric submersible pump system of claim 1, wherein:

the chemical chamber comprises a cavity bounded by an outer housing, a filter, a chemical chamber inner tube, a head, and a floor portion; and chemical chamber tubing extending from the head of the chemical chamber into the chemical chamber cavity; and the head is configured to attach to a pump, the chemical chamber inner tube is configured to surround a shaft;

wherein a passage is formed between the filter and the chemical chamber inner tube, the passage terminating at a bottom of the chemical chamber;

wherein a neutralization chemical resides in the chemical chamber cavity.

11. The electric submersible pump system of claim 10, wherein the chemical chamber tubing extends from the head down to within 25% of a bottom length of the chemical chamber cavity.

12. The electric submersible pump system of claim 1, wherein the chemical chamber comprises a filter located between the neutralization chemical and the motor protection component.

13. An electric submersible pump system for use in a wellbore comprising:

a pump;

a motor protection component having an oil chamber and a wellbore fluid chamber;

a motor component, the motor component comprising oil and being fluidly coupled to the oil chamber of the motor protection component; and a chemical chamber that includes a neutralization chemical;

the chemical chamber being configured to contact fluid from the wellbore with the neutralization chemical and being fluidly coupled to the wellbore fluid chamber of the motor protection component;

wherein the pump is configured to be driven by the motor component;

wherein the chemical chamber comprises a filter located between the neutralization chemical and the motor protection component.

14. The electric submersible pump system of claim 13, wherein tubing is fluidly coupled to the chemical chamber at one end and at another end is fluidly coupled to the wellbore fluid chamber of the motor protection component.

15. The electric submersible pump system of claim 13, wherein chemical chamber tubing runs through a head of the chemical chamber and the chemical chamber tubing is fluidly coupled to an intake opening for wellbore fluid.

16. The electric submersible pump system of claim 13, further comprising a shaft extending from the motor component to the pump;

wherein a base of the chemical chamber and a head of the motor protection component form a chamber, wherein a first and second section of the shaft is coupled together.

17. An electric submersible pump system for use in a wellbore comprising:

a pump;

a motor protection component having an oil chamber and a wellbore fluid chamber;

a motor component, the motor component comprising oil and being fluidly coupled to the oil chamber of the motor protection component; and a chemical chamber that includes a neutralization chemical;

the chemical chamber being configured to contact fluid from the wellbore with the neutralization chemical and being fluidly coupled to the wellbore fluid chamber of the motor protection component;

wherein the pump is configured to be driven by the motor component;

wherein tubing is fluidly coupled to the chemical chamber at one end and at another end is fluidly coupled to the wellbore fluid chamber of the motor protection component.

18. The electric submersible pump system of claim 17, wherein the chemical chamber comprises a filter located between the neutralization chemical and the motor protection component.

19. The electric submersible pump system of claim 17, wherein chemical chamber tubing runs through a head of the chemical chamber and the chemical chamber tubing is fluidly coupled to an intake opening for wellbore fluid.

20. The electric submersible pump of claim 17, wherein the neutralization chemical comprises: one or more components selected from the group consisting of: phosphonates, phosphoric acid, ortho phosphates, a polymer having a weight average molecular weight of 500,000 g/mol to 1,000,000 g/mol, a polyethylene oxide polymer, and a metal chelator.

* * * * *